US007156712B1

(12) United States Patent
Mercer

(10) Patent No.: US 7,156,712 B1
(45) Date of Patent: Jan. 2, 2007

(54) FLOATING DEBRIS AND WEEDLINE MARKER

(76) Inventor: Mark T. Mercer, P.O. Box 22281, Fort Lauderdale, FL (US) 33335

( * ) Notice: Subject to any disclaimer, the term of this patent is extended or adjusted under 35 U.S.C. 154(b) by 0 days.

(21) Appl. No.: 10/812,569

(22) Filed: Mar. 30, 2004

Related U.S. Application Data

(60) Provisional application No. 60/461,021, filed on Apr. 7, 2003.

(51) Int. Cl.
*B63B 22/16* (2006.01)

(52) U.S. Cl. ..... 441/6; 441/11; 441/23; 441/28

(58) Field of Classification Search ..... 441/6, 441/1, 3, 12, 11, 13, 16, 28, 23
See application file for complete search history.

(56) References Cited

U.S. PATENT DOCUMENTS 3,084,354 A * 4/1963 Lunenschloss ..... 441/11
3,390,408 A * 7/1968 Lockwood, Jr. ..... 441/3
3,568,228 A * 3/1971 Rudelick ..... 441/3
4,123,813 A * 11/1978 Adams ..... 441/11
4,144,606 A * 3/1979 McIntyre ..... 441/11
4,669,989 A * 6/1987 Havlick ..... 441/1
5,088,948 A * 2/1992 Scheurer ..... 441/1
5,273,468 A * 12/1993 Nichols ..... 441/6
5,351,414 A * 10/1994 Cogliano ..... 33/719
5,411,424 A * 5/1995 Hill ..... 441/11
6,488,554 B1 * 12/2002 Walker ..... 441/3

* cited by examiner

*Primary Examiner*—Ed Swinehart
(74) *Attorney, Agent, or Firm*—Daniel S. Polley, P.A.

(57) ABSTRACT

A marker for marking debris, weed lines and/or other objects floating in a body of water. The marker can consist of a tube, such as a plastic tube having a weighted end such that the marker floats upright in the ocean. Preferably, the marker is coated with a fluorescent color such as the color orange or other highly visible coloring. A reflective strip of material can also be disposed at the end (non-weighted end) of the marker which extends out of the water. A loop can be provided at the non-weighted end of the marker such that the marker can be retrieved by a gaff, boat hook, fishing rod, etc. A piece of floating material, such as foam, can be disposed at an intermediate portion of the tube and defines the amount of material or portion of the tube that extends out of the water.

28 Claims, 5 Drawing Sheets

FLOATING DEBRIS AND WEEDLINE MARKER

This Application claims priority to and the benefit of U.S. application Ser. No. 60/461,021, filed Apr. 7, 2003 which is incorporated by reference.

FIELD OF THE INVENTION

This invention relates to fishing markers and particularly to a floating marker for use to identify floating debris and weed lines in the ocean.

BACKGROUND OF THE INVENTION

Offshore fishermen often look for floating debris and weeds as a place where game fish may be congregated. Though debris and/or weed lines may be spotted floating in the ocean, by the time the boat is turned around often such debris or weed line are difficult to find again. Accordingly, what is needed is a marker which will identify weed lines and debris floating in the ocean and which will also move with the weed line and debris in the ocean and allow the weed line and/or debris to be easier spotted by the boater/fisherman.

SUMMARY OF THE INVENTION

A marker is provided for use in marking identified debris, weed lines and/or other items floating in a body of water, such as, but not limited to, an ocean. The marker can also be used to refind previously identified items where the user has lost contact with the item(s) for whatever reason (e.g. turning the boat around). The marker can consist of a tube, such as a plastic tube having a weighted end such that the marker floats upright in the ocean. Preferably, the marker is coated with a fluorescent color such as the color orange or highly visible coloring. A reflective strip of material can also be disposed at the end (non-weighted end) of the marker which extends out of the water. A loop can be provided at the non-weighted end of the marker such that the marker can be retrieved by a gaff, boat hook, fishing rod, etc. A piece of floating material, such as foam, can be disposed at an intermediate portion of the tube and defines the amount of material or portion of the tube that extends out of the water.

It is an object of the present invention to provide a marker for marking a position of an object within a body of water.

It is another object of the present invention to provide a marker for marking debris or a weed line floating in a body of water.

It is still another object of the present invention to permit a boater to more easily refind an object floating in a body of water after the boater has at least momentarily lost contact with the object.

It is yet another object of the present invention to provide a marker which is easily retrieved from a body of water by a boater.

It is noted that the subject matter discussed in the above Summary of the Invention is not intended to limit the scope of the claims of the present invention.

DESCRIPTION OF THE PREFERRED EMBODIMENT

Figure 1:
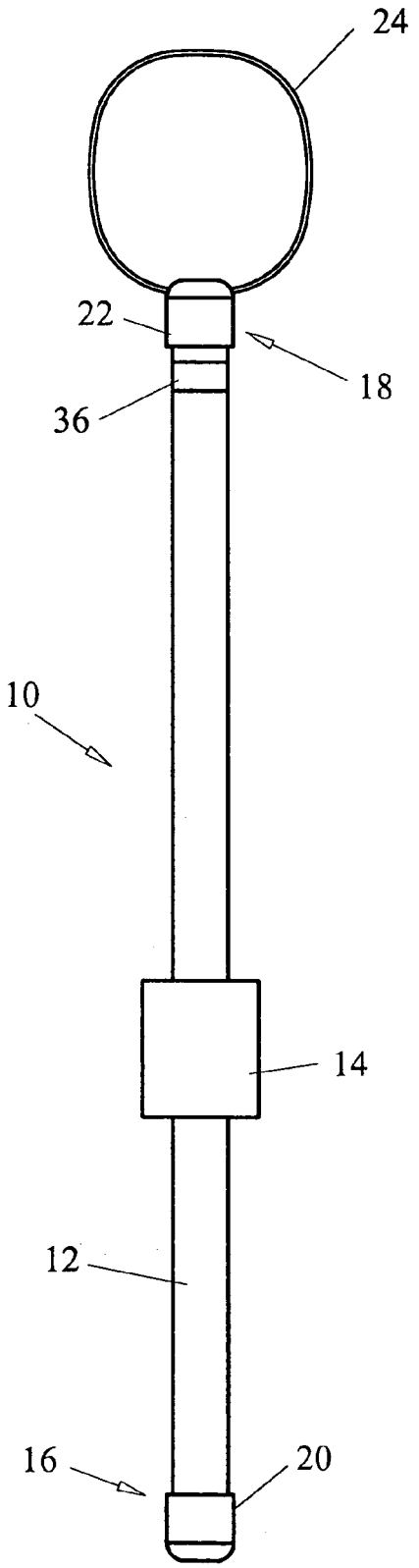
FIG. 1 is a top view of the present invention marker.

As seen in the figures, the invention provides a floating weed line and debris marker generally designated as reference number 10. Marker 10 includes an elongated tube or pipe 12 ("tube") which can be preferably constructed from plastic, such as, but not limited to, ABS or PVC, or other similar materials. A floatable member, such as foam material 14, is attached along an intermediate portion of tube 12. Tube 12 includes a first end 16 and a second end 18. The position of floatable member 14 on tube 12 determines the portion of tube 12 that protrudes out of the water when in use. Tube 12 can be preferably colored with a highly visible color, such as a fluorescent color. The fluorescent color can be orange but such color is not considered limiting. A reflective strip 36 can also be provided at exposed end 18 of tube 12.

Floatable member 14 is preferably a piece of foam, though other floatable devices can be used (i.e. inflatable bladder, etc.).

Figure 2:
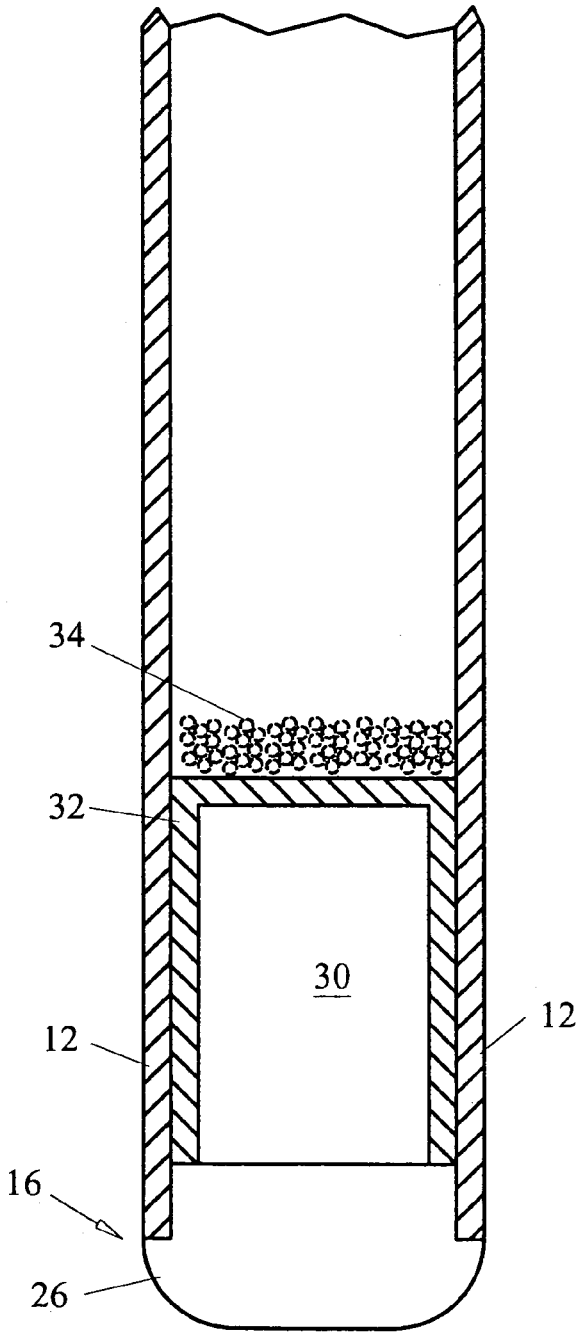
FIG. 2 is a sectional view of a first embodiment of the weighted end for the marker illustrated in FIG. 1 also illustrating a plug at the end as an alternative to the cap shown in FIG. 1.

A cap member 20 (FIG. 1) or plug 26 (FIG. 2) can be provided at first end 16, as well as at exposed end 18. By using plug 26 as opposed to cap 20, the diameter at first end 16 remains consistent, and allows marker 10 to be more easily disposed within a conventional fishing rod holder when not in use. However, a cap 20 end can also still allow marker 10 to be disposed within a conventional fishing rod holder.

Disposed within tube 12 at first end 16 is a weight member 30. The type of weight or material is not considered limited to anyone design. In the preferred embodiment, the weight member can be steel, however, other materials such as lead or other metals can also be used and are all considered within the scope of the invention. The steel or other metal can be a solid piece, though it is within the scope of the invention to provide more than one weight at weighted end 16. In a first embodiment (FIG. 2), a resin or adhesive 32, can be provided within tube 12 at the first end 16 to maintain weight member 30 properly in position at first end 16 such that weight 30 becomes static. In one embodiment the combined weight of the resin/adhesive 32 and weight 30 is approximately 10 ounces. However, such amount is not considered limited and other weights can be used and are considered within the scope of the invention.

Figure 6:
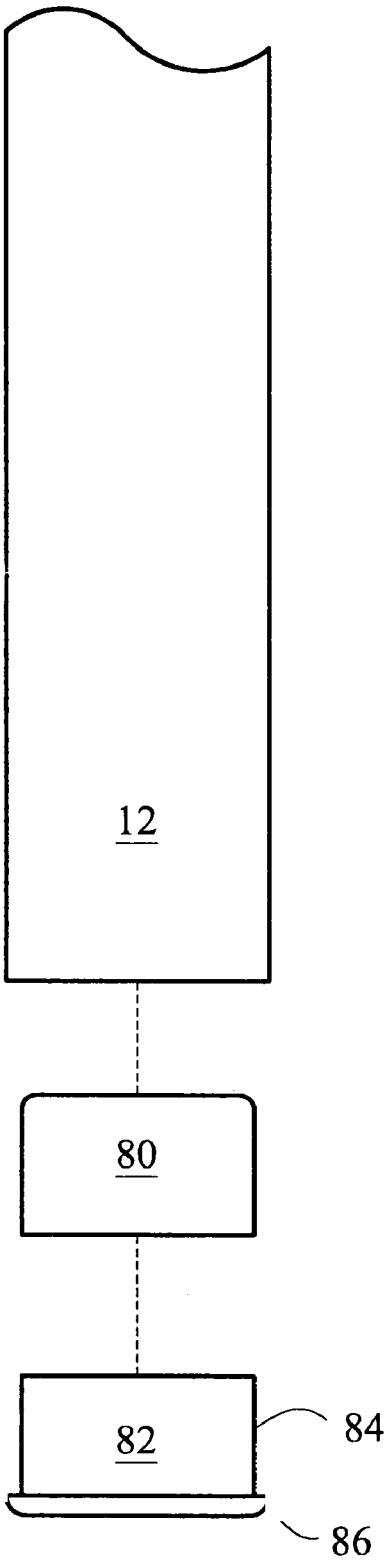
FIG. 6 is an exploded view of a second embodiment of the weighted end of the marker.
Figure 7:
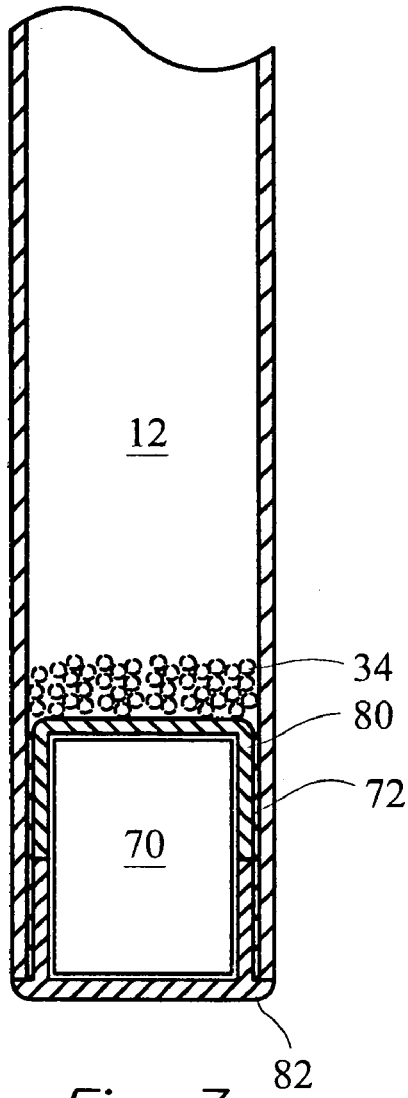
FIG. 7 is a sectional view of the second embodiment weighted end for the marker.

FIGS. 6 and 7 illustrate a second embodiment for maintaining a weight member at first end 16, such as weight member 70, which can be similar or identical to weight member 30. An internal plug/baffle 80 (preferably having a heavy duty/high strength adhesive 72 disposed on at least a portion of its outer side surface) is inserted within tube 12 to a desired or predetermined location within tube 12. Adhesive 72 helps to retain plug 80 at its chosen position within tube 12. Weight 70 is then inserted within tube 12 followed by a top portion 84 of plug 82 preferably until a stop portion 86 of plug 82 contacts end 16 of tube 12.

Similar to the outer side surface of plug 80, at least a portion of the side surface of top portion 84 can be provided with adhesive 72 to help retain plug 82 at end 16 of tube 12. The size of plug 80 and/or top portion 84 of plug 82 can be chosen such that they are snugly received within tube 12. Thus, the snug relationship, though not preferred, can permit plug 80 and/or top portion 84 of plug 82 to remain properly positioned with respect to tube 12 without the use of adhesive 72. The size of weight member 70 can be chosen such that it is slightly smaller then the space defined by plug 80 and plug 82, such that weight member 70 is permitted minimal movement within the space to help prevent weight member 70 from effecting the position of plug 80 and/or plug 82 with respect to tube 12. Though not required, plug 80 and top portion 84 of plug 82 can be abutting each other when properly positioned with respect to tube 12.

It is also within the scope of the invention to provide inner protrusions, flanges, etc. on a selected location of the inner wall of tube 12 to function as a stop member for an inserted weight member.

The preferred length of tube 12 is approximately 30 inches but, again, this size is not considered limiting and other dimensions can be used and considered within the scope of the invention. Exposed end 18 is provided with a cap 22, which can alternatively a plug similar to plug 26. Attached to cap 22 or plug 23 (FIG. 5) is a loop 24. Loop 24 can be inserted through an aperture in the plug or end cap 22, welded to the plug or cap 22 or otherwise connected to the plug or cap 22 at exposed end 18. A seen in FIG. 4, loop 24 allows marker 10 to be easily retrieved from a boat by a boat hook, fishing rod, person's hand, etc. Look can be constructed from one or more materials such as but not limited to, plastic, nylon, etc. One or more rattles, marbles or other noise/sound producing devices 34 can be disposed within tube 12 to attract fish to the area.

Figure 5:
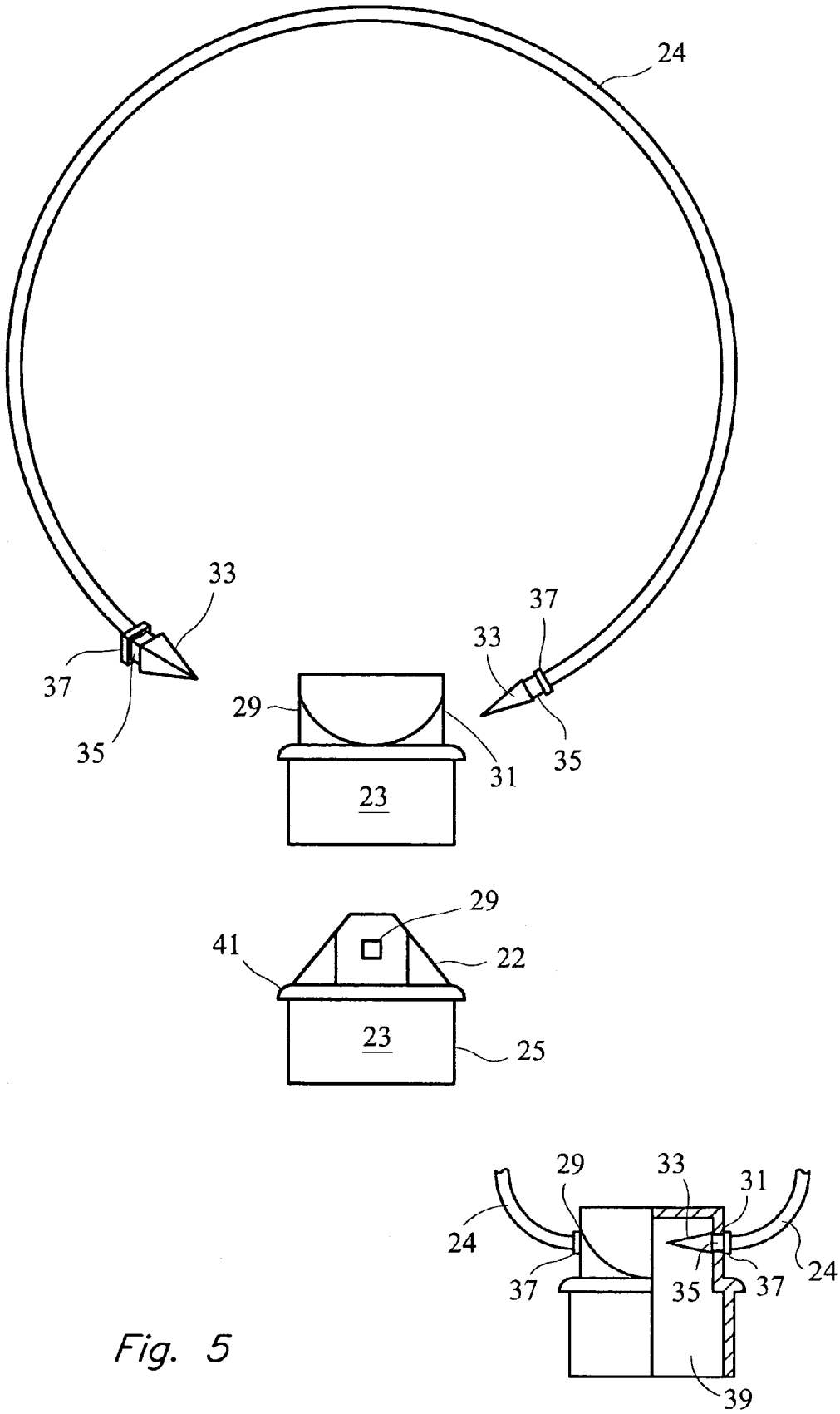
FIG. 5 are various view illustrating one embodiment for the top end of the marker.

As seen in the various drawings of FIG. 5, loop 24 can be provided with pyramid shaped ends 33 which are inserted through apertures 29 and 31 of an exposed top portion 27 of plug 23 for disposal within an internal area 39 of plug 23. Though preferably pyramid shaped, ends 33 can be constructed from other shapes which permit entry within internal area 39 through apertures 29 and 31. The size of apertures 29 and 31 can be slightly smaller than the abutting portion of pyramid shaped ends 33 to maintain ends 33 within internal area 30 after insertion through apertures 29 and 31. Given the possible slightly large size of abutting portion, a slight amount of force may be needed to insert ends 33 through apertures 29 and 31. Stop members 37 on loop 24 restrict how far into internal area 39 ends 33 are permitted to travel. Though shown as square in shape, stop members 37 are not limited to any particular shape. Thus, the size of stop members 37, as opposed to shape, is more important, with the size being selected such that stop members cannot under normal conditions be inserted within apertures 29 and 31. Thus, when properly attached (ends 33 within internal area 39), loop 24 is maintained at its desired upright or outward position (FIG. 1) for easier retrieval of marker 10.

Mating portions 35 of loop 24 preferably can be shaped to correspond to the shape of its respective aperture 29 or 31. Though not limiting, apertures 29 and 31 and mating portions 35 can be substantially square shaped to help reduce or prevent loop 24 from being rotated or positioned in a downward position back to tube 12. As the square shape prevents loop 24 from easily rotating, a desired position of loop 24 with respect to tube 12 (See FIG. 1) can be maintained to permit marker 10 to be retrieved from the water easier by a user. Other shapes for apertures 29 and/or 31, and/or one or both of mating portions 35 can also be selected and are considered within the scope of the invention (e.g. octagon, pentagon, hexagon, triangle, etc.). Furthermore, though shown and discussed in conjunction with plug 23, an exposed top portion 27 can also be provided with cap 22 for mating with the above discussed loop 24.

Similar to top portion 84 discussed above, a bottom internal portion 25 of plug 23 is preferably inserted within tube 12 until end 18 of tube 12 comes into contact with stop portion 41 of plug 23. A portion of the side surface of bottom internal portion 25 can be provided with adhesive 72 to help retain plug 23 at end 18 of tube 12. The size of bottom portion 25 can be chosen such that it is snugly received within tube 12. Thus, though not preferred, the snug relationship can permit plug 23 to remain properly positioned with respect to tube 12 without the use of adhesive 72.

Figure 3:
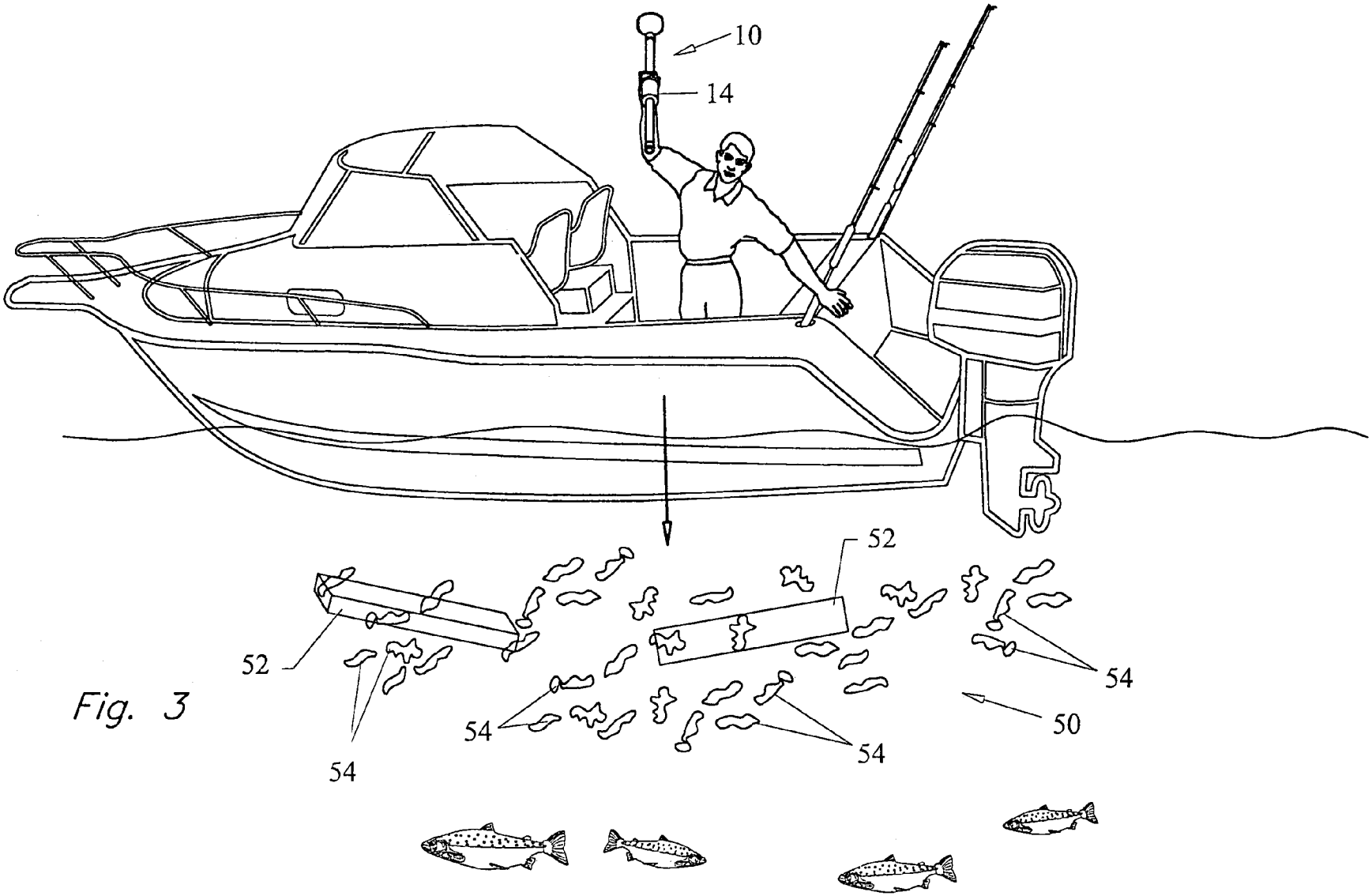
FIG. 3 is a perspective view illustrating how the invention is used just prior to marking of the debris and/or weed lines.
Figure 4:
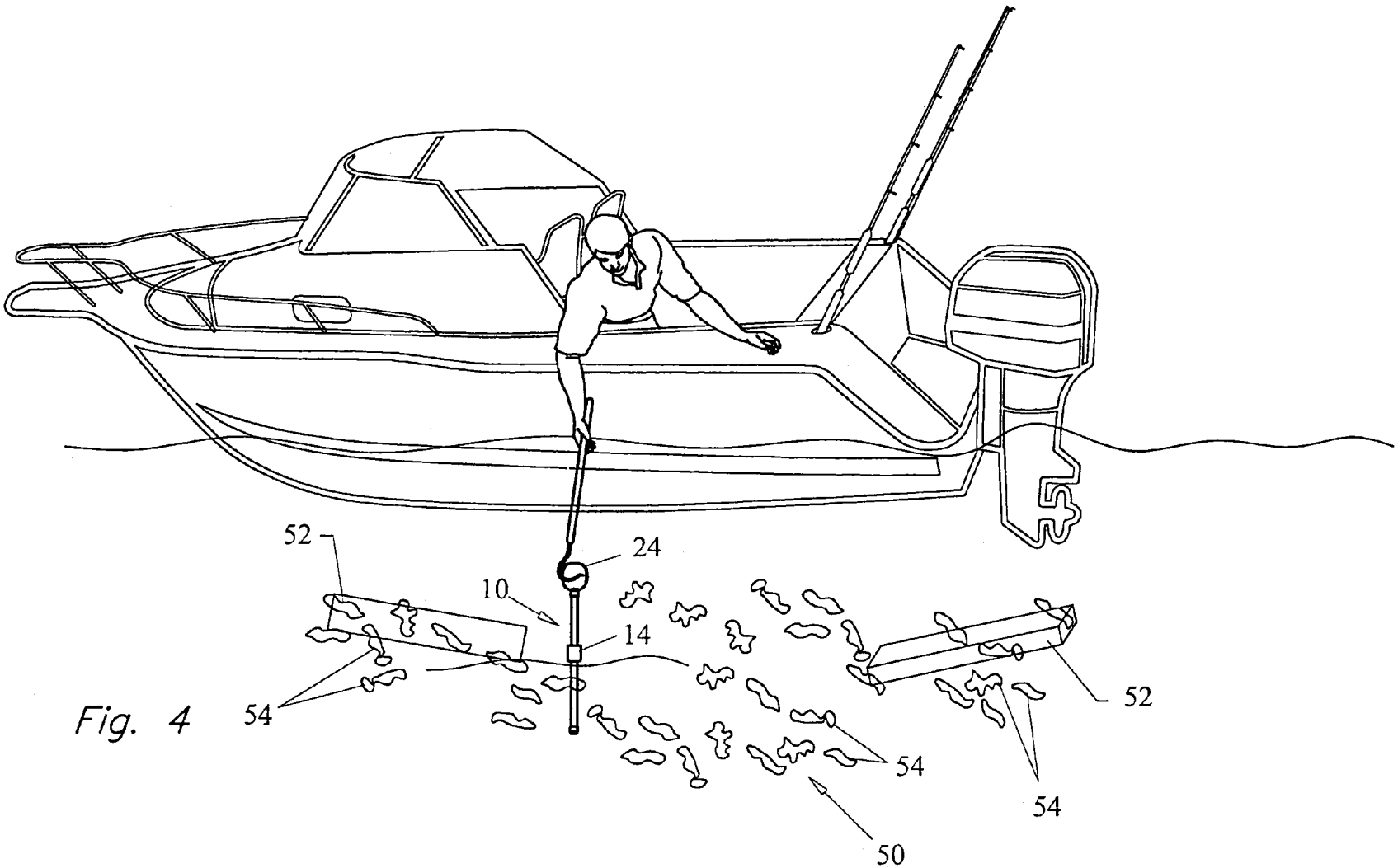
FIG. 4 is a perspective view illustrating a method for retrieving the marker from the water.

In use, once the person spots a desired area 50 having a weed line 54 and/or other floating debris 52, or some other area or item in the water which the user desires to mark, the user grabs the marker 10 and throws the marker at the intended area 50 (See FIG. 3). As seen in FIG. 4, the weight 30 and/or resin/adhesive 32 (or weight member 70 and/or resin/adhesive 72) disposed at end 16 causes the marker 10 to float upright with a portion of tube 12 defined by the location of float 14 on tube 12 extending out of the water. As the material for the exterior surface of tube 12 is preferably highly visible, marker 10 is easily seen. Thus, debris and weed lines often lost are now marked and again findable by the boater after turning the boat around. As seen in FIG. 4, once area 50 has been relocated and/or the individual on the boat are ready to leave, marker 10 is easily retrieved through the use of a gaff or other item and loop 24.

As marker 10 is unrestricted when reaching the water, it moves and floats in the waves at the same pace and direction as the debris and/or weed lines that it is marking. Thus, even though the debris and weed lines are moving, marker 10 still correctly identifies their current location. When not in use, given the size of marker 10, it can be disposed within a fishing rod holder or any other desired location. Though ideally used in the ocean, marker 10 can be used in any body of water. A plurality of markers 10 can be used for the above described purpose.

One or more markers 10 can also be used to identify a location where, a person, animal or object falls into the water to make retrieval of such person, animal or object easier. One or more markers 10 can be thrown in the water at the location of a dive, and then used to determine current flow of the body water. One or more markers 10 can also be used to mark oil spills, and can be tossed from a boat or flying object (i.e. helicopter, low-flying plane, etc.). Marker 10 can also be used to track water currents to help attempt to detect rip tides.

The cap or plug attached at weighted end 16 can be provided with a hook, adaptor, clip, eyelid, etc. for attaching objects such as, but not limited to, a tethered line. In this embodiment, the marker could be used to identify reef, ship wrecks or other objects disposed at the bottom of the body of water.

It should also be recognized the marker 10 can be provided with a transceiver/homing device and/or light element to also aid in locating marker 10, especially at night.

The instant invention has been shown and described herein in what is considered to be the most practical and preferred embodiment. It is recognized, however, that departures may be made therefrom within the scope of the invention and that obvious modifications will occur to a person skilled in the art.

The invention claimed is:

1. A marker for use in marking an object disposed within or floating on a body of water, said marker comprising:

an elongated tube having a first end and a second end;

a weight internally disposed within said elongated tube at a first end of said elongated tube; and a floatable member externally disposed on said elongated tube at an intermediate position along said elongated tube;

wherein when positioned within a body of water to mark an object said first end of said tube is disposed underwater and a portion of elongated tube protrudes out of the body of water; and one or more rattle members disposed within said elongated tube between said weight and the second end of said elongated tube, wherein said elongated tube having a length and said one or more rattle members movable within said elongated tube over a majority of the length of said elongated tube.

2. The marker of claim 1 wherein at least a portion of the elongated tube that protrudes out of the body of water is provided with a high fluorescent color to improve visibility of said elongated tube.

3. The marker of claim 1 further including a loop member attached at a second end of said elongated tube to aid in retrieving said elongated tube from a body of water.

4. The marker of claim 1 wherein said floatable member is a piece of foam.

5. The marker of claim 1 wherein said weight is a piece of steel.

6. The marker of claim 1 further including a reflective strip disposed approximate to the second end of said elongated tube.

7. The marker of claim 1 wherein said elongated tube having a virtually consistent same outer diameter from its first end to its second end and everywhere in between said first end and said second end.

8. The marker of claim 1 wherein said floatable member having a virtually consistent same outer diameter from its first end to its second end and everywhere in between said first end and said second end.

9. A marker for use in marking an object disposed within or floating on a body of water, said marker comprising:

an elongated tube having a first end and a second end;

a weight internally disposed within said elongated tube at a first end of said elongated tube;

a floatable member externally disposed on said elongated tube at an intermediate position along said elongated tube; and a loop assembly disposed at the second end of said elongated tube, said loop assembly including a cord member and a plug member, said plug member disposed within said elongated tube to close the second end of said elongated tube, said cord member attached to said plug member to form a loop at said second end of said elongated tube for easier retrieval of said elongated tube out of a body of water;

wherein when positioned within a body of water to mark an object said first end of said tube is disposed underwater and a portion of elongated tube protrudes out of the body of water.

10. The marker of claim 9 wherein at least a portion of the elongated tube that protrudes out of the body of water is provided with a high fluorescent color to improve visibility of said elongated tube.

11. The marker of claim 9 wherein said floatable member is a piece of foam.

12. The marker of claim 9 wherein said weight is a piece of steel.

13. The marker of claim 9 further including one or more rattle members disposed within said elongated tube between said weight and the second end of said elongated tube, wherein said elongated tube having a length and said one or more rattle members movable within said elongated tube over a majority of the length of said elongated tube.

14. The marker of claim 9 further including a reflective strip disposed approximate to the second end of said elongated tube.

15. The marker of claim 9 wherein said elongated tube having a virtually consistent same outer diameter from its first end to its second end and everywhere in between said first end and said second end.

16. The marker of claim 9 wherein said floatable member having a virtually consistent same outer diameter from its first end to its second end and everywhere in between said first end and said second end.

17. A marker for use in marking an object disposed within or floating on a body of water, said marker comprising:

an elongated tube having a first end and a second end;

a weight disposed at a first end of said elongated tube;

a floatable member disposed at an intermediate position along said elongated tube; and a loop assembly disposed at the second end of said elongated tube, said loop assembly including a cord member and a plug member, said plug member disposed within said elongated tube to close the second end of said elongated tube, said cord member attached to said plug member to form a loop at said second end of said elongated tube for easier retrieval of said elongated tube out of a body of water;

wherein when positioned within a body of water to mark an object said first end of said tube is disposed underwater and a portion of elongated tube protrudes out of the body of water;

wherein said plug member having a wall member defining an internal area and a first aperture and a second aperture disposed on an exposed portion of the wall member, said cord member having a first insertion end and a second insertion end;

wherein said first insertion end having a first member disposed through said first aperture and into said internal area, said first insertion end having a first stop member and a first intermediate member, said first stop member defining the distance the first member travels within said internal area and positions the first intermediate member such that it is at least partially disposed within said first aperture;

wherein said second insertion end having a second member disposed through said second aperture and into said internal area, said second insertion end having a second stop member and a second intermediate member, said second stop member defining the distance the second member travels within said internal area and positions the second intermediate member such that it is at least partially disposed within said second aperture;

wherein a bottom portion of said first member is at least slightly larger than said first aperture such that said first member is retained within said internal area;

wherein a bottom portion of said second member is at least slightly larger than said second aperture such that said second member is retained within said internal area.

18. The marker of claim 17 wherein said first member of said first insertion end is substantially pyramid shaped and said second member of said second insertion end is substantially pyramid shaped.

19. The marker of claim 17 wherein said first aperture and at least a portion of said first intermediate member are both substantially square shaped and said second aperture and at least a portion of said second intermediate member are both substantially square shaped to maintain said cord member in an upright position.

20. A marker for use in marking an object disposed within or floating on a body of water, said marker comprising:

an elongated tube having a first end and a second end;

a weight internally disposed within said elongated tube at a first end of said elongated tube;

means for preventing said weight from significantly moving from its internally disposed position at the first end of said elongated tube, said means for preventing internally disposed within said elongated tube; and a floatable member externally disposed on said elongated tube at an intermediate position along said elongated tube;

wherein when positioned within a body of water to mark an object said first end of said tube is disposed underwater and a portion of elongated tube protrudes out of the body of water;

wherein said means for preventing is an internal plug entirely disposed internally within and attached to said elongated tube and an end plug disposed at said first end of the said elongated tube, said weight disposed between said internal plug and said end plug.

21. The marker of claim 20 wherein at least a portion of the elongated tube that protrudes out of the body of water is provided with a high fluorescent color to improve visibility of said elongated tube.

22. The marker of claim 20 further including a loop member attached at a second end of said elongated tube to aid in retrieving said elongated tube from a body of water, said loop member not extending within said elongated tube.

23. The marker of claim 20 wherein said floatable member is a piece of foam.

24. The marker of claim 20 further including a reflective strip disposed approximate to the second end of said elongated tube.

25. The marker of claim 20 wherein said elongated tube having a virtually consistent same outer diameter from its first end to its second end and everywhere in between said first end and said second end.

26. The marker of claim 20, wherein said floatable member having a virtually consistent same outer diameter from its first end to its second end and everywhere in between said first end and said second end.

27. A marker for use in marking an object disposed within or floating on a body of water, said marker comprising:

an elongated tube having a first end and second end;

a weight internally disposed within said elongated tube at a first end of said elongated tube;

means for preventing said weight from significantly moving from its internally disposed position at the first end of said elongated tube, said means for preventing internally disposed within said elongated tube; and a floatable member externally disposed on said elongated tube at an intermediate position along said elongated tube;

wherein when positioned within a body of water to mark an object said first end of said tube is disposed underwater and a portion of elongated tube protrudes out of the body of water;

one or more rattle members disposed within said elongated tube between said weight and the second end of said elongated tube, wherein said elongated tube having a length and said one or more rattle members movable within said elongated tube over a majority of the length of said elongated tube.

28. A marker for use in marking an object disposed within or floating on a body of water, said marker comprising:

a monolithically formed single piece elongated tube having a first end and a second end, said elongated tube having a substantially consistent same outer diameter from its first end to its second end and everywhere in between said first end and said second end;

a weight internally disposed within said elongated tube at a first end of said elongated tube, weight member having an outer diameter smaller then the inner diameter of said elongated tube;

means for preventing said weight from significantly moving from its internally disposed position at the first end of said elongated tube, said means for preventing internally disposed within said elongated tube;

a foam member externally disposed on said elongated tube at an intermediate position along said elongated tube, said foam member having a virtually consistent same outer diameter from its first end to its second end and everywhere in between said first end and said second end; and a loop assembly disposed at the second end of said elongated tube, said loop assembly including a cord member and a plug member, said plug member disposed within said elongated tube to close the second end of said elongated tube, said cord member attached to said plug member to form a loop at said second end of said elongated tube for easier retrieval of said elongated tube out of a body of water, said cord member not extending within said elongated tube;

wherein when positioned within a body of water to mark an object said first end of said tube is disposed underwater and a portion of elongated tube protrudes out of the body of water;

wherein at least a portion of the elongated tube that protrudes out of the body of water is provided with a high fluorescent color to improve visibility of said elongated tube.

* * * * *